US010245462B2

(12) United States Patent
Endelman

(10) Patent No.: US 10,245,462 B2
(45) Date of Patent: Apr. 2, 2019

(54) CARRIAGE SIT BOX FOR REFORMER EXERCISE APPARATUS

(71) Applicant: Balanced Body, Inc., Sacramento, CA (US)

(72) Inventor: Ken Endelman, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 197 days.

(21) Appl. No.: 15/434,493

(22) Filed: Feb. 16, 2017

(65) Prior Publication Data

US 2018/0229071 A1 Aug. 16, 2018

(51) Int. Cl.
*A63B 21/00* (2006.01)
*A63B 22/00* (2006.01)
*A47C 9/00* (2006.01)

(52) U.S. Cl.
CPC ..... *A63B 21/4027* (2015.10); *A47C 9/002* (2013.01); *A63B 22/0087* (2013.01)

(58) Field of Classification Search
CPC ..... A63B 21/00047; A63B 21/0005; A63B 21/00054; A63B 21/065; A63B 21/068; A63B 21/1609; A63B 21/1672; A63B 21/4027; A63B 21/4029; A63B 21/4037; A63B 21/4039; A63B 22/0046; A63B 22/0076; A63B 22/0087; A63B 22/0089; A63B 26/00; A63B 26/003; A63B 69/06; A63B 71/0036; A63B 2210/00; A63B 2210/50; A63B 2225/09; A63B 2225/093; A47C 9/002
See application file for complete search history.

(56) References Cited

U.S. PATENT DOCUMENTS 5,154,678 A * 10/1992 Adamczyk ..... A63B 23/0458 108/90
5,158,512 A * 10/1992 Irwin ..... A63B 23/0458 482/142
D360,767 S * 8/1995 Fish ..... D21/671
5,584,786 A * 12/1996 Almeda ..... A63B 21/00047 482/140
5,672,144 A * 9/1997 Hulme ..... A63B 23/0211 482/140
D555,741 S * 11/2007 Wachtfogel ..... D21/662
7,591,763 B1 * 9/2009 Fucci ..... A63B 21/0552 482/121
7,833,145 B2 * 11/2010 Ko ..... A63B 21/0552 482/123
7,922,624 B1 * 4/2011 Fairhurst ..... A63B 21/0552 482/52

(Continued)

*Primary Examiner* — Gary D Urbiel Goldner
(74) *Attorney, Agent, or Firm* — Greenberg Traurig, LLP

(57) ABSTRACT

A sit box for use on a reformer exercise apparatus carriage is a unitary body having a rectangular flat top surface portion joining four curved portions. Each curved portion merges with one of an upright front wall, an upright back wall, an upright left side wall, and an upright right side wall. The walls terminate at a generally flat rectangular bottom parallel to the top surface portion. Each wall curves to merge with an adjacent wall. Each of the left and right side walls has an outwardly open vertical recess therein adjacent the front wall to receive within each recess one of a pair of shoulder stops projecting from the carriage.

20 Claims, 7 Drawing Sheets

(56) References Cited

U.S. PATENT DOCUMENTS

| | | | | |
|---|---|---|---|---|
| 8,033,969 | B2 * | 10/2011 | Feltz | A63B 22/16 482/142 |
| RE43,981 | E * | 2/2013 | Endelman | A63B 21/4037 482/121 |
| 9,327,157 | B1 * | 5/2016 | Miller | A63B 21/4043 |
| 2007/0117695 | A1 * | 5/2007 | Endelman | A63B 21/00047 482/140 |
| 2007/0197360 | A1 * | 8/2007 | Rester | A61H 1/02 482/23 |
| 2008/0004167 | A1 * | 1/2008 | Endelman | A63B 21/00047 482/142 |
| 2009/0229048 | A1 * | 9/2009 | Maganov | A63B 21/4037 5/420 |
| 2012/0165167 | A1 * | 6/2012 | Hauptmann | A63B 21/16 482/123 |
| 2014/0141948 | A1 * | 5/2014 | Aronson | A63B 21/023 482/128 |
| 2015/0111701 | A1 * | 4/2015 | Kempka | A63B 5/16 482/15 |
| 2015/0196799 | A1 * | 7/2015 | Chua | A63B 23/1236 482/141 |
| 2016/0151655 | A1 * | 6/2016 | Gilley | A63B 5/16 482/142 |
| 2016/0199689 | A1 * | 7/2016 | Irwin | A63B 23/0458 482/142 |
| 2017/0065845 | A1 * | 3/2017 | Pinkus | A63B 21/0552 |
| 2017/0209728 | A1 * | 7/2017 | Lagree | A63B 21/00069 |
| 2018/0229098 | A1 * | 8/2018 | McCorkle | A63B 71/0054 |

* cited by examiner

CARRIAGE SIT BOX FOR REFORMER EXERCISE APPARATUS

BACKGROUND OF THE DISCLOSURE

The present disclosure is directed to exercise equipment and more particularly to a sit box for use on the carriage of a reformer exercise apparatus.

An exemplary conventional reformer exercise apparatus 10 is shown in FIGS. 1 and 2. The apparatus 10 includes a rectangular frame 12 and a movable carriage 14 mounted for reciprocal movement between a head end 16 and a foot end 18 of the frame 12. The carriage 14 has a generally flat cushioned upper surface 20 and a pair of fixed or removable shoulder stops 22 fastened to the carriage 14. A conventional sit box 24 is positioned crosswise on the carriage 14 in FIG. 1. The conventional sit box 24 is positioned longitudinally on the carriage 14 in FIG. 2. The sit box 24 is a hollow box having no bottom, and a solid top, with four vertical sides. The sit box 24 is most securely positioned on the carriage 14 when it is butted up against the shoulder stops 22 and the bottom periphery of all four sides rests on the upper surface 20 of the carriage 14. A user of the apparatus 10 must carefully position the sit box 24 on the carriage 14 such that is centrally positioned and equally supported along its bottom periphery on the carriage 14. In FIG. 1, this is achieved by butting the box 24 against the shoulder stops 22. In FIG. 2, this is achieved by ensuring that the sides of the box 24 and the ends both rest on the upper surface of the carriage 14.

Care must be taken, however, to ensure that the box is centered and that a user, when sitting or lying on the box 24, doesn't put too much of his or her weight on either end of the box 24 as those ends are not supported by the carriage 14 if positioned as shown in FIG. 1. A user should always be properly centered on the box 24 and the box 24 properly centered, in turn, on the carriage 14. Furthermore, conventional sit boxes 24 are typically made of heavy hardwood plywood and thus are somewhat difficult for small users of the equipment to handle and position properly on a reformer exercise apparatus. What is therefore needed is a more lightweight sit box that is easy to manipulate and position, has a relatively large bottom surface area to securely mount on the carriage of a reformer, and easily center properly on the reformer carriage.

SUMMARY OF THE DISCLOSURE

A sit box in accordance with the present disclosure directly addresses the above identified needs. An exemplary sit box for use on a carriage of a reformer exercise apparatus in accordance with the present disclosure is a unitary block shaped body, preferably molded of closed cell polymer foam. The unitary body has a rectangular flat top surface portion merging via curved wall portions into an upright front wall, an upright back wall, an upright left side wall, and an upright right side wall. These walls terminate at a flat bottom parallel to the top surface portion. The bottom has a plurality of spaced upwardly extending recesses into the body including at least two spaced vertical recesses therein adjacent the front wall each adapted to receive therein one shoulder stop of a pair of shoulder stops projecting from a reformer exercise apparatus carriage when the sit box is positioned on the carriage.

Each of the vertical recesses is preferably outwardly open and preferably extends through one of the left and right side walls adjacent the front wall. Each vertical recess is upwardly tapered and spaced from each other by at least one and preferably two support ribs extending from the bottom toward the top portion. The two spaced support ribs extending from the bottom toward the top portion define therebetween one of the spaced recesses. Each of the outwardly open upright recesses extending through the side walls is preferably tapered.

The sit box bottom preferably has a plurality of spaced recesses between the front and back walls each extending upward toward the top wall. The front wall and the back wall each preferably has a cutaway portion forming a hand hold adjacent the bottom of the body, for a user to grasp and carry the sit box. Each cutaway portion of the front wall and the back wall merges into one of the recesses extending from the bottom internally upward toward the top wall.

Each wall has a curved portion joining the flat top surface portion. The flat top surface portion has a first plurality of spaced grooves therein parallel to the left and right side walls and a second plurality of spaced shallow grooves parallel to the end walls, forming a crisscrossed array of grooves creating squares or rectangles in the surface portion upon which a user sits.

A sit box for use on a reformer exercise apparatus carriage in accordance with this disclosure may be viewed as a unitary polymer body having a rectangular flat top surface portion and four curved portions each merging with one of an upright front wall, upright back wall, upright left side wall, and an upright right side wall. The walls each terminate at a generally flat bottom parallel to the top surface portion. The left and right side walls each has a vertical recess therein adjacent the front wall adapted to receive within each vertical recess one of a pair of shoulder stops that extend upward from the reformer carriage when the sit box is positioned on the carriage thereby capturing the sit box on the carriage.

The sit box flat bottom includes a plurality of recesses each extending upward internally toward the top surface. The sit box includes two vertical recesses adjacent the front wall that are spaced from each other by at least one support rib extending from the bottom toward the top surface portion. Preferably the vertical recesses are spaced from each other by two spaced support ribs extending from the bottom toward the top portion defining one of the recesses. The front wall and the back wall each has a cutaway portion between the two support ribs forming a hand hold in the wall adjacent the bottom of the body. The cutaway portion of the front wall and the back wall each merges into the one of the recesses between the two spaced support ribs.

A sit box in accordance with the present disclosure for use on a reformer exercise apparatus carriage may be viewed as a unitary solid body having a rectangular flat top surface portion joining four curved portions each merging with one of an upright front wall, back wall, left side wall, and a right side wall, wherein the walls terminate at a generally flat rectangular bottom parallel to the top surface portion and wherein each wall curves to merge with an adjacent wall. The left and right side walls each preferably has an outwardly open upright vertical recess therein adjacent the front wall adapted to receive within each vertical recess one of a pair of shoulder stops projecting from the carriage.

The outwardly open vertical recesses are spaced from each other by at least one support rib extending from the bottom toward the top portion, and preferably spaced from each other by two spaced support ribs extending from the bottom internally toward the top portion. The sit box bottom has a plurality of recesses extending upward internally toward the top surface portion forming a grid of vertical ribs therebetween. Each of the front and back walls has a cutout adjacent the bottom merging into one of the recesses forming a hand hold for a user to grasp the box when arranging the box on a reformer carriage.

Further features, advantages and characteristics of the embodiments of this disclosure will be apparent from reading the following detailed description when taken in conjunction with the drawing figures.

DETAILED DESCRIPTION

Figure 1:
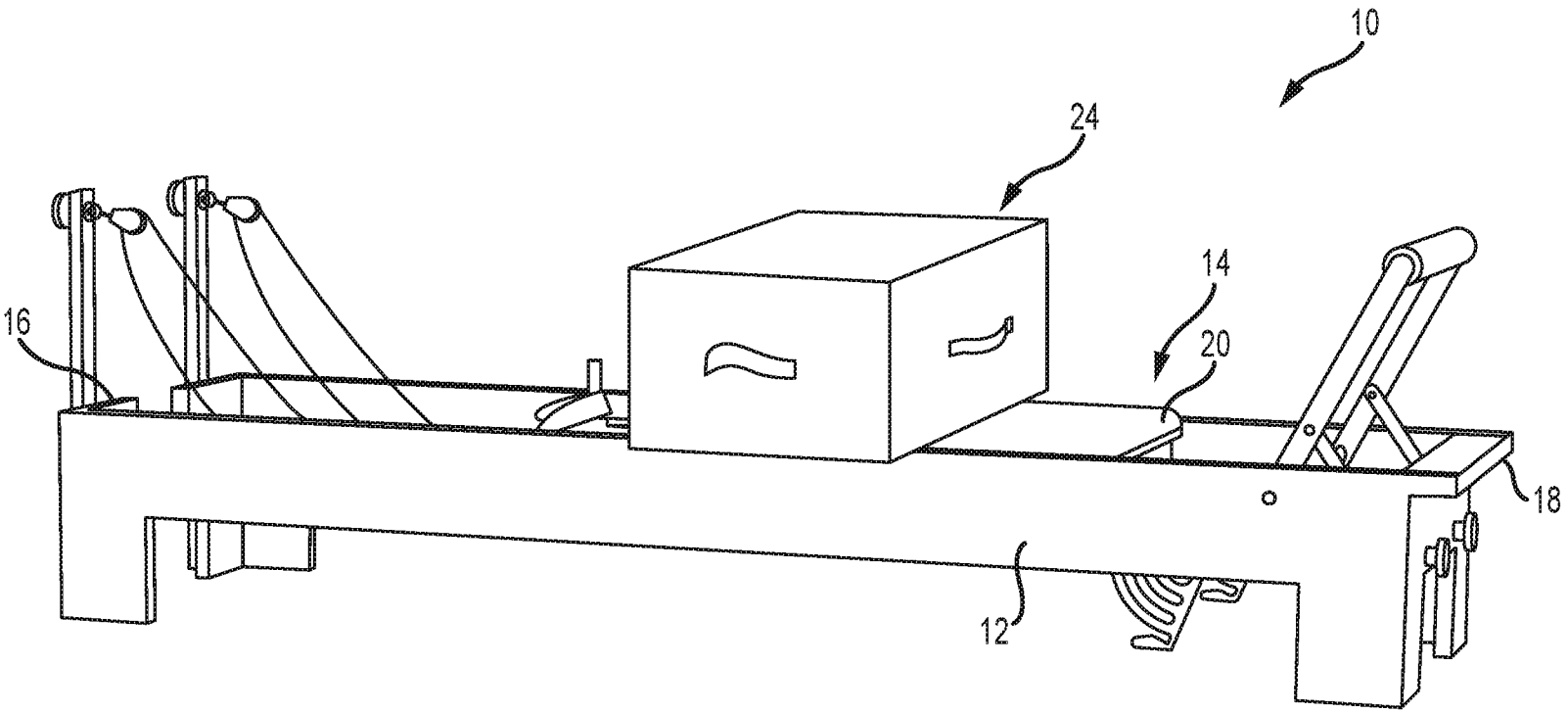
FIG.1 PRIOR ART
FIG. 1 is a perspective view of a conventional sitting box positioned laterally on the carriage of a reformer exercise apparatus.
Figure 2:
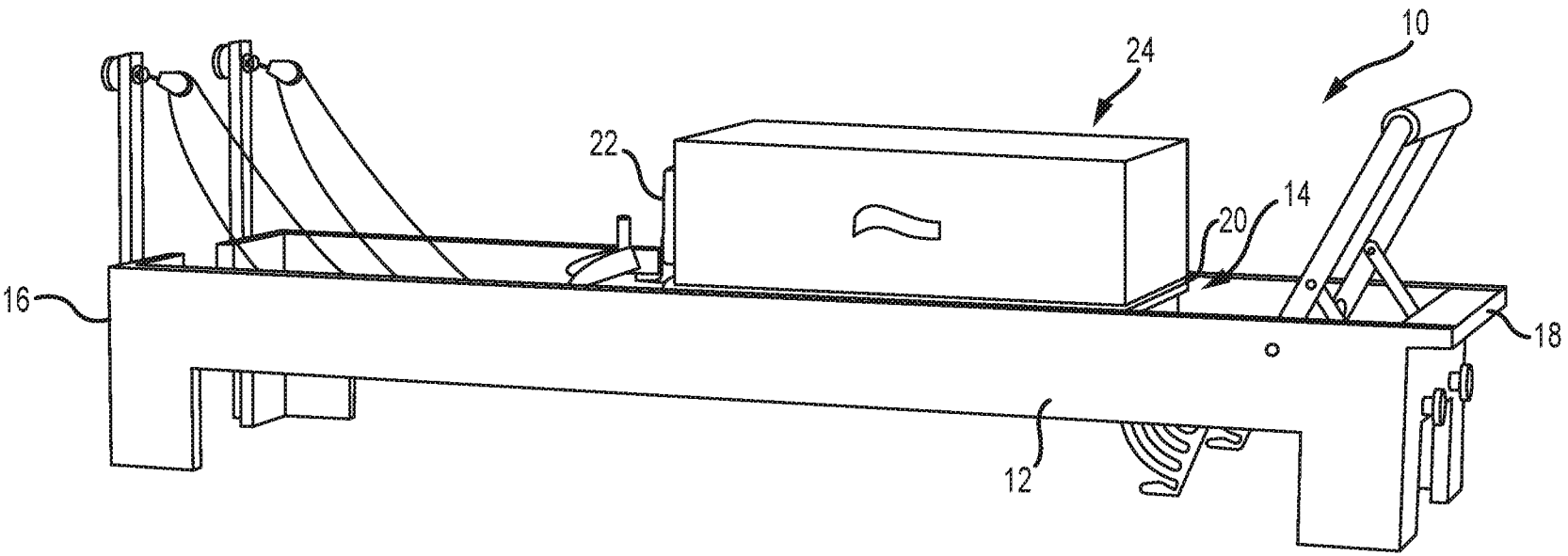
FIG. 2 PRIOR ART
FIG. 2 is a perspective view of the conventional sitting box shown in FIG. 1 positioned longitudinally on the carriage of the reformer exercise apparatus.
Figure 3:
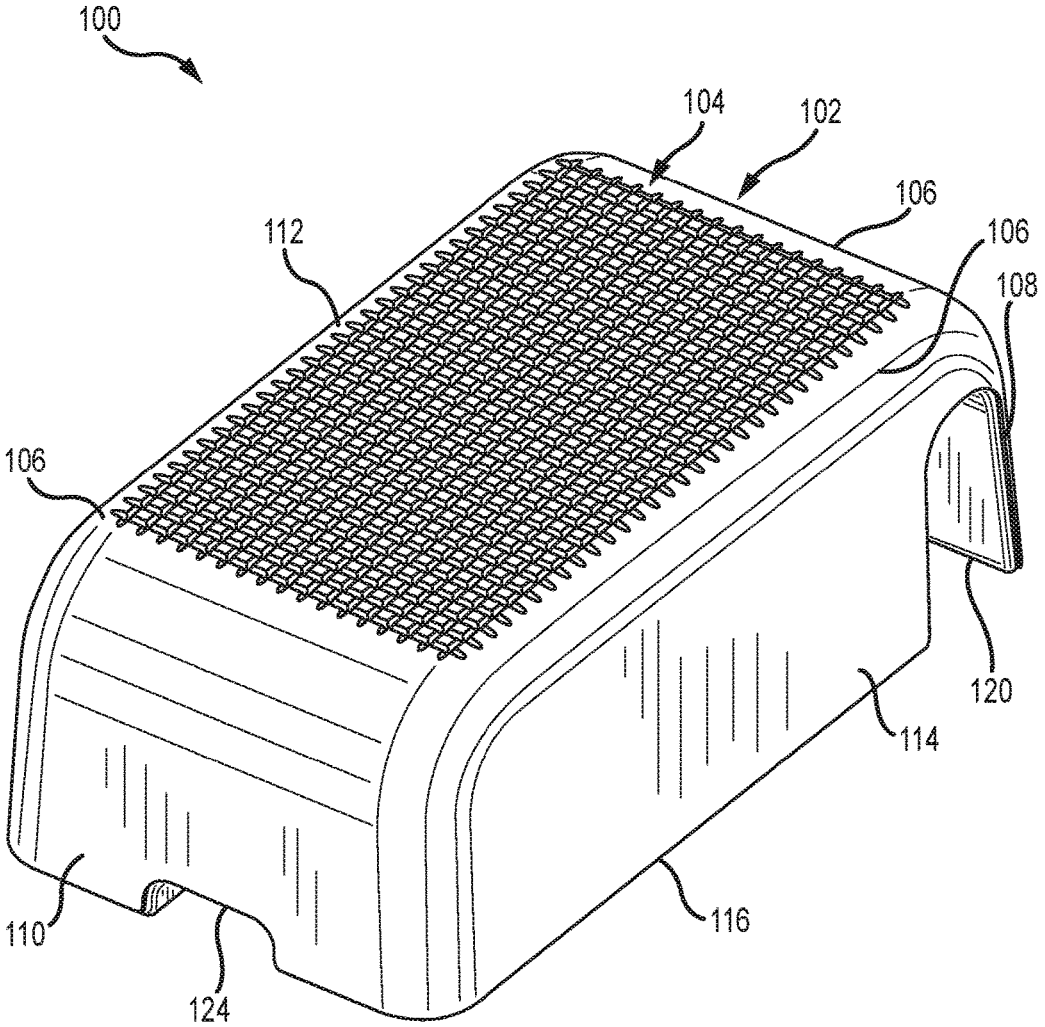
FIG. 3 is upper perspective view of a sitting box in accordance with the present disclosure.
Figure 4:
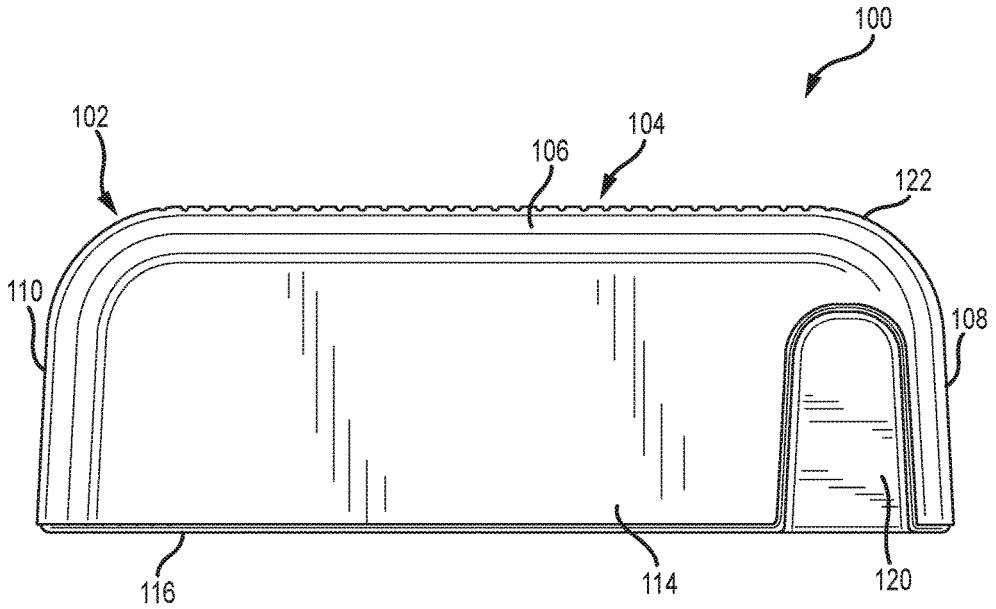
FIG. 4 is right side view of the sitting box shown in FIG. 3.
Figure 5:
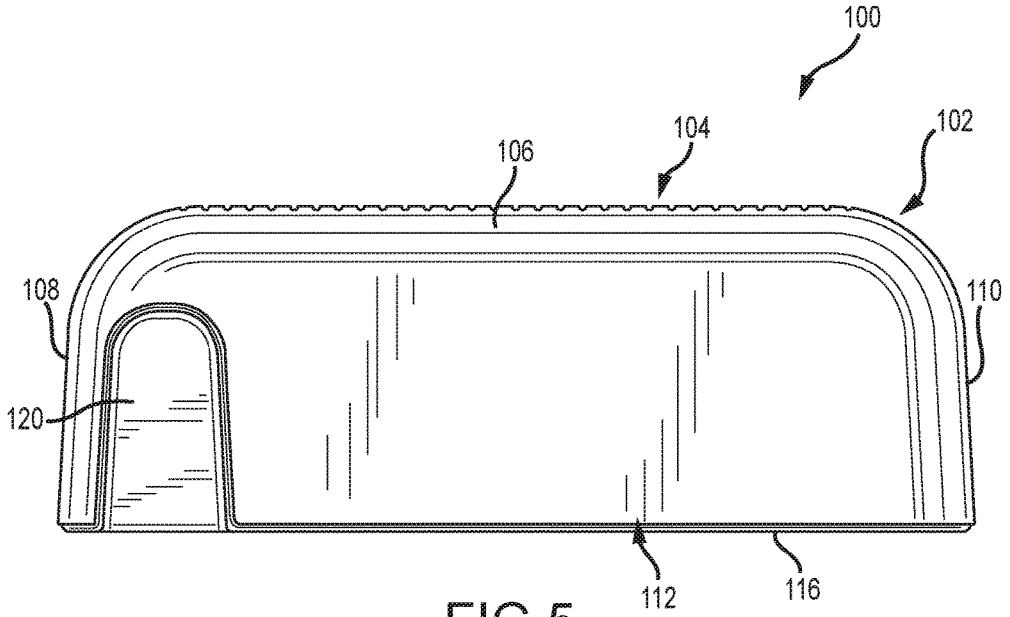
FIG. 5 is a left side view of the sitting box shown in FIG. 3.
Figure 6:
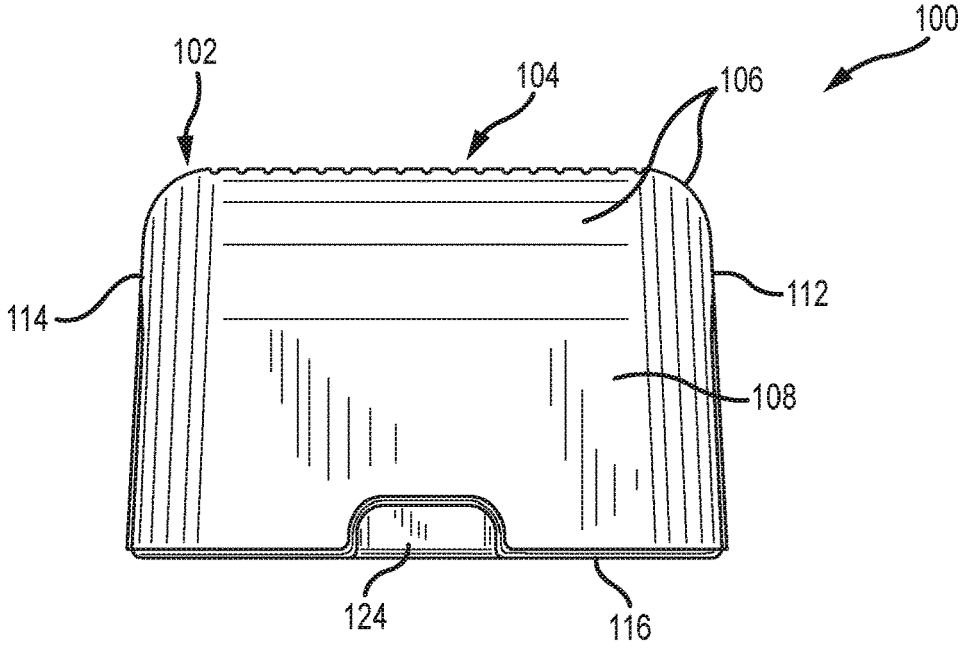
FIG. 6 is a front view of the sitting box shown in FIG. 3.
Figure 7:
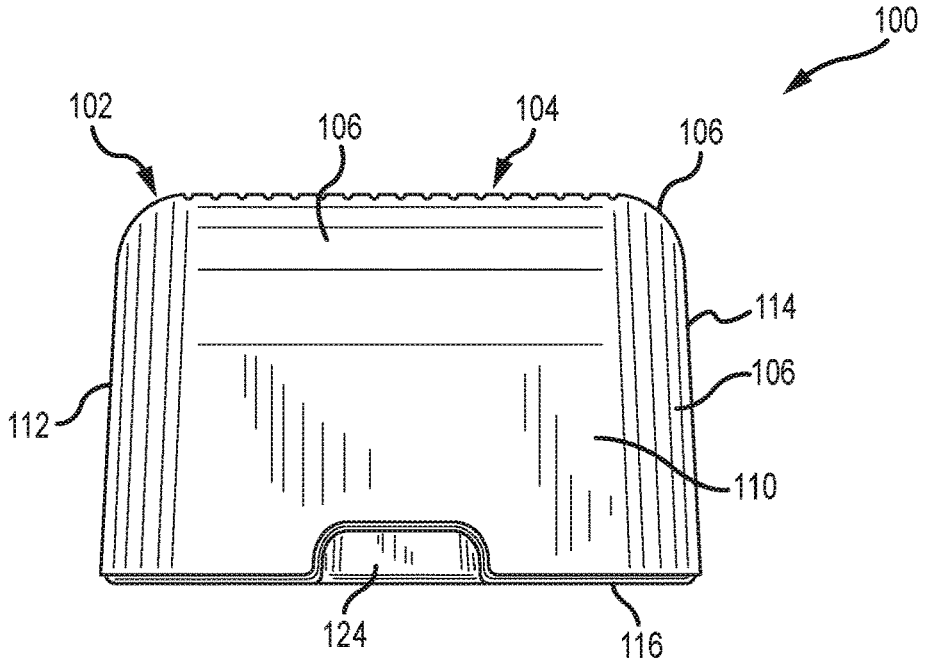
FIG. 7 is a back view of the sitting box shown in FIG. 3.
Figure 8:
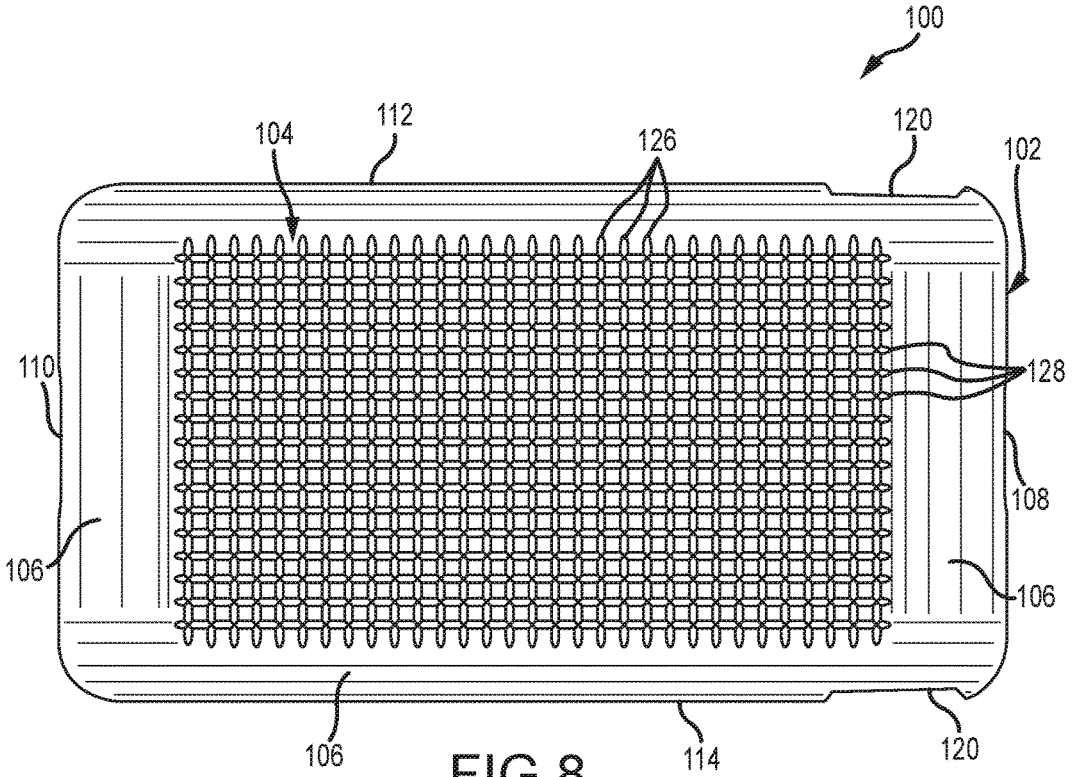
FIG. 8 is top plan view of the sitting box shown in FIG. 3.
Figure 9:
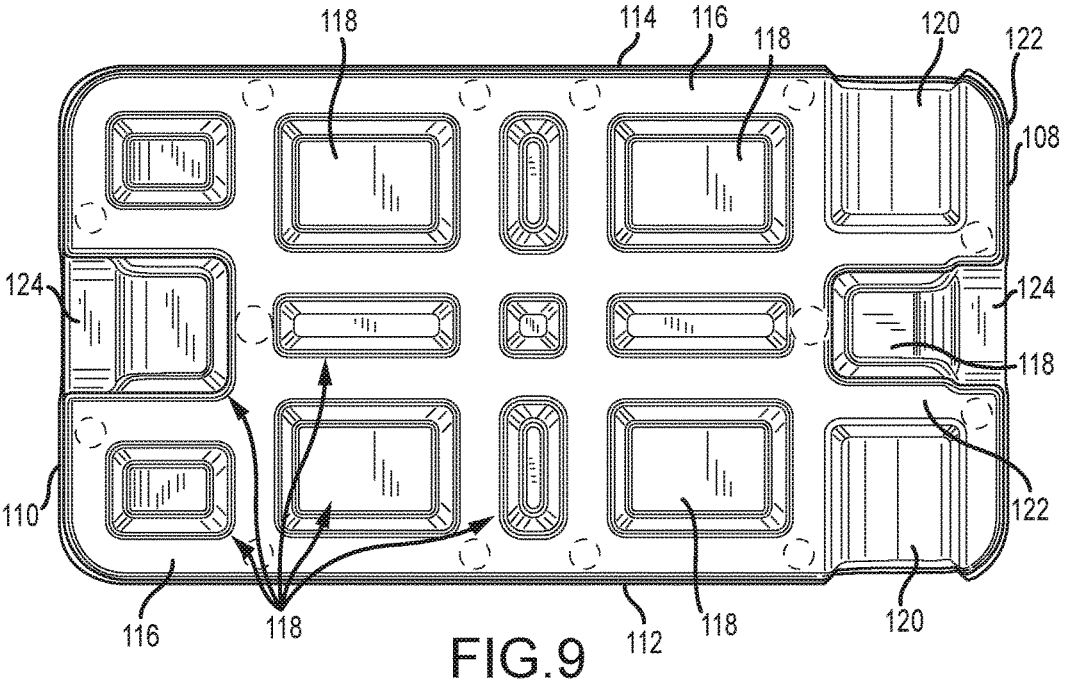
FIG. 9 is a bottom plan view of the sitting box shown in FIG. 3.

An exemplary sit box 100 for use on a carriage 14 of a reformer exercise apparatus 10 in accordance with the present disclosure is shown in a separate upper perspective view in FIG. 3. Side views, end views, and top and bottom views are shown in FIGS. 4 through 9. A perspective view of the sit box 100 is shown properly positioned longitudinally on a carriage 14 of a reformer exercise apparatus 10 in FIG. 10.

Figure 10:
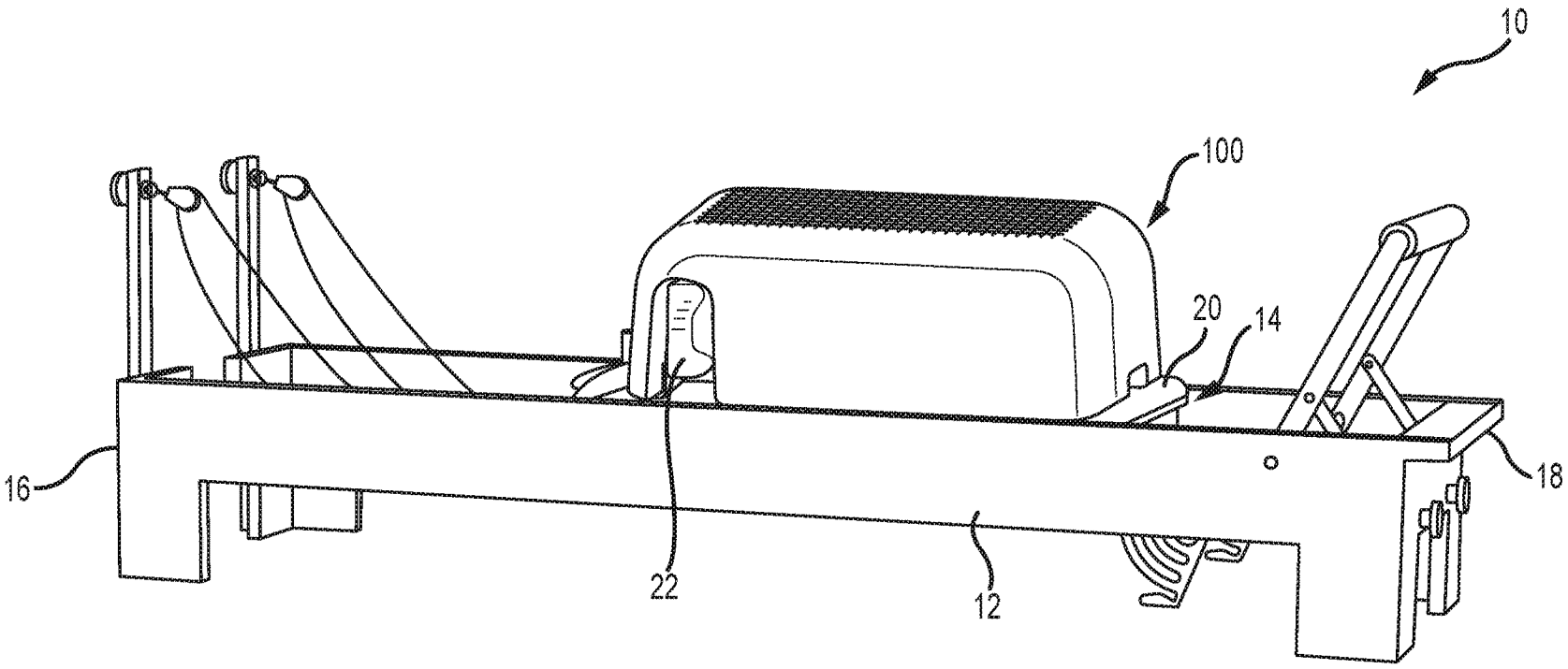
FIG. 10 is a perspective view of the sit or sitting box shown in FIG. 3 positioned longitudinally on the carriage of a reformer exercise apparatus.

The sit box 100 has a unitary block shaped body 102, preferably molded of closed cell polymeric structural foam. The exemplary body 102 has a rectangular flat top surface portion 104 merging via curved wall portions 106 into an upright front wall 108, an upright back wall 110, an upright left side wall 112, and an upright right side wall 114. These walls 108, 110, 112, and 114 terminate at a flat bottom 116 parallel to the top surface portion 104. The bottom 116 has a plurality of spaced upwardly extending recesses 118 into the body 102 including at least two spaced vertical recesses 120 therein adjacent the front wall 108 each adapted to receive therein one shoulder stop 22 of a pair of shoulder stops 22 projecting from the upper surface 20 of a reformer exercise apparatus carriage 14 when the sit box 100 is positioned longitudinally on the carriage 14. A side view of a reformer exercise apparatus 10 with the sit box 100 oriented in this configuration is shown in FIG. 10.

Each of the vertical recesses 120 is preferably outwardly open and extends through one of the left and right side walls 112 and 114, respectively, adjacent the front wall 108. The side walls of each vertical recess 120 are upwardly tapered. The vertical recesses 120 are spaced from each other by at least one and preferably two support ribs 122 extending upward internally from the bottom 116 toward the top surface portion 104. The two spaced support ribs 122 extend upward internally from the bottom 116 toward the top surface portion 104 and define therebetween one of the spaced recesses 118. Each of the outwardly open upright recesses 120 extending through the side walls 112 and 114 is preferably tapered.

The sit box bottom 116 preferably has a plurality of symmetrically spaced recesses 118 between the front and back walls 108 and 110 each extending upward internally toward the top surface portion 104 inside the block body 102. The front wall 108 and the back wall 110 each preferably has a cutaway portion 124 forming a hand hold adjacent the bottom 116 of the body 102, for a user to grasp and carry the sit box 100. Each cutaway portion 124 of the front wall 108 and the back wall 110 merges into one of the recesses 118 extending from the bottom 116 upward internally toward the top surface portion 104.

The top surface portion 104 has an array of crisscrossed transverse and longitudinal spaced shallow grooves 126 and 128 respectively forming a gripping surface for contact with a user's body when the user is sitting or reclining on the box 100. These grooves may be oriented in a variety of different ways and alternatively may be replaced with an etched design in the top surface portion 104.

The vertical recesses 120 are preferably outwardly open as shown. However, they may alternatively be covered, i.e. totally within the block body 102, essentially being blind recesses through the bottom 116 into the body 102. In such an alternative embodiment, the surfaces of the external walls 112 and 114 would be unbroken, i. e., smooth. Also, in the embodiment 100 shown, as well as in an alternative, two of the spaced recesses 118 adjacent the left and right sides 112 and 114 may be spaced apart similarly to the vertical recesses 120 such that when the sit box 100 is positioned laterally across a carriage 14 the shoulder stops 22 fit within the two spaced recesses 118 so that the sit box 100 is centered across the carriage 14 with the shoulder stops 22 hidden from view.

All such changes, alternatives and equivalents in accordance with the features and benefits described herein, are within the scope of the present disclosure. Any or all of such changes and alternatives may be introduced without departing from the spirit and broad scope of this disclosure.

The invention claimed is:

1. A sit box for use on a carriage of a reformer exercise apparatus, the sit box comprising:

a unitary block shaped body having a rectangular flat top surface portion merging via curved wall portions into an upright front wall, an upright back wall, an upright left side wall, and an upright right side wall, wherein the upright front wall, the upright back wall, the upright left side wall and the upright right side wall terminate at a flat bottom parallel to the rectangular flat top surface portion, the rectangular flat top surface portion having a plurality of features providing a gripping surface for contact with a user's body, wherein the flat bottom has a plurality of spaced recesses including at least two spaced vertical recesses therein adjacent to the upright front wall, each of the at least two spaced vertical recesses adapted to receive therein one shoulder stop of a pair of shoulder stops projecting from the carriage of the reformer exercise apparatus, and wherein a vertical height of each of the at least two spaced vertical recesses, as measured along the respective upright left and upright right side walls and from the flat bottom upward toward the rectangular flat top surface portion, is greater than a horizontal width of each of the respective at least two spaced vertical recesses.

2. The sit box according to claim 1 wherein each of the at least two spaced vertical recesses is outwardly open through one of the upright left and right side walls adjacent to the upright front wall.

3. The sit box according to claim 1 wherein the at least two spaced vertical recesses are spaced from each other by at least one support rib extending from the flat bottom toward the rectangular flat top surface portion.

4. The sit box according to claim 1 wherein the at least two spaced vertical recesses are spaced from each other by two spaced support ribs extending from the flat bottom toward the rectangular flat top surface portion defining one of the at least two spaced vertical recesses.

5. The sit box according to claim 1 wherein the upright front wall and the upright back wall each has a cutaway portion forming a hand hold adjacent to the flat bottom of the unitary block shaped body.

6. The sit box according to claim 5 wherein each cutaway portion of the upright front wall and the upright back wall merges into one of the one of the plurality of spaced recesses different from the at, least two spaced vertical recesses, wherein the one of the plurality of s aced recesses extends from the flat bottom upward toward the rectangular flat top surface portion.

7. The sit box according to claim 6 wherein the plurality of spaced recesses of the flat bottom, including the at least two spaced vertical recesses are located between the upright front and back walls, and wherein each of the plurality of spaced recesses, including the at least two spaced vertical recesses, extends upward toward the rectangular flat top surface portion.

8. The sit box according to claim 2 wherein each of the at least two spaced vertical recesses in the upright left and right side walls is tapered.

9. The sit box according to claim 1 wherein the plurality of features of the rectangular flat top surface portion include a first plurality of spaced grooves therein parallel to the upright left and right side walls and a second plurality of spaced grooves crossing the first plurality of spaced grooves parallel to the upright front and upright back walls.

10. The sit box according to claim 1 wherein each of the upright front wall, the upright back wall, the upright left side wall, and the upright right side wall has one of the curved wall portions merging with the rectangular flat top surface portion.

11. A sit box for use on a reformer exercise apparatus carriage, the sit box comprising:

a single polymer body having a rectangular flat top surface portion and four curved portions each merging with one of an upright front wall, an upright back wall, an upright left side wall, and an upright right side wall, wherein the walls each terminate at a generally flat bottom parallel to the rectangular flat top surface portion, the rectangular flat top surface portion having a plurality of features providing a gripping surface for contact with a user's body, wherein the upright left and right side walls each has a vertical recess therein adjacent to the upright front wall adapted to receive within each vertical recess one of a pair of shoulder stops extending upward from the reformer exercise apparatus carriage when the sit box is positioned on the reformer exercise apparatus carriage thereby capturing the sit box on the reformer exercise apparatus carriage, and wherein a vertical height of each vertical recess, as measured along the respective upright left and upright right side walls and from the generally flat bottom upward toward the rectangular flat top surface portion, is greater than a horizontal width of each respective vertical recess.

12. The sit box according to claim 11 wherein the generally flat bottom has a plurality of recesses which includes the vertical recesses, and wherein each of the plurality of recesses, including the vertical recesses, extends upward toward the rectangular flat top surface portion.

13. The sit box according to claim 11 wherein the vertical recesses are spaced from each other by at least one support rib extending from the generally flat bottom toward the rectangular flat top surface portion.

14. The sit box according to claim 12 wherein the vertical recesses are spaced from each other by two spaced support ribs extending from the generally flat bottom toward the rectangular flat top surface portion, wherein the two spaced support ribs define the vertical recesses, and wherein the vertical recesses are tapered.

15. The sit box according to claim 14 wherein the upright front wall and the upright back wall each has a cutaway portion forming a hand hold in the upright front wall and the upright back wall, respectively, adjacent to the generally flat bottom of the single polymer body.

16. The sit box according to claim 15 wherein the cutaway portion of the upright front wall and the upright back wall each merges into one of the plurality of recesses, different from the vertical recesses, between the two spaced support ribs.

17. A sit box for use on a reformer exercise apparatus carriage, the sit box comprising:

a single solid body having a rectangular flat top surface portion joining four curved portions each merging with one of an upright front wall, an upright back wall, a left side wall, and a right side wall, wherein the walls terminate at a generally flat rectangular bottom parallel to the rectangular flat top surface portion, the rectangular flat top surface portion having a plurality of features providing a gripping surface for contact with a user's body, wherein each wall curves to merge with an adjacent wall, wherein the left and right side walls each has an outwardly open upright vertical recess therein adjacent to the upright front wall adapted to receive within each outwardly open upright vertical recess one of a pair of shoulder stops projecting from the reformer exercise apparatus carriage, and wherein a vertical height of each outwardly open upright vertical recess, as measured along the respective left and right side walls and from the generally flat rectangular bottom upward toward the rectangular flat top surface portion, is greater than a horizontal width of each respective outwardly open upright vertical recess.

18. The sit box according to claim 17 wherein the outwardly open upright vertical recesses are spaced from each other by at least one support rib extending from the generally flat rectangular bottom toward the rectangular flat top surface portion.

19. The sit box according to claim 18 wherein the outwardly open upright vertical recesses are spaced from each other by two spaced support ribs extending from the generally flat rectangular bottom toward the rectangular flat top surface portion.

20. The sit box according to claim 19 wherein the generally flat rectangular bottom has a plurality of recesses different from the outwardly open upright vertical recesses, wherein each of the plurality of recesses extends upward toward the rectangular flat top surface portion forming a grid of vertical ribs, different from the at least one support rib and the two spaced support ribs, therebetween and wherein each of the upright front and back walls has a cutout adjacent to the generally flat rectangular bottom merging into one of the plurality of recesses different from the outwardly open upright vertical recesses, wherein each cutout forms a hand hold.

* * * * *